US006419150B1

(12) United States Patent
Papageorge

(10) Patent No.: US 6,419,150 B1
(45) Date of Patent: Jul. 16, 2002

(54) PATTERN AND METHOD OF ASSEMBLING AN ENVELOPE/PAGE AND MAILER COMBINATION

(76) Inventor: Irene V. Papageorge, 74 Barnswallow Dr., Trumbull, CT (US) 06611

( * ) Notice: Subject to any disclaimer, the term of this patent is extended or adjusted under 35 U.S.C. 154(b) by 0 days.

(21) Appl. No.: 09/436,339

(22) Filed: Nov. 8, 1999

Related U.S. Application Data

(60) Provisional application No. 60/107,619, filed on Nov. 9, 1998.

(51) Int. Cl.[7] ..... B65D 27/00
(52) U.S. Cl. ..... 229/68.1; 229/69; 229/75
(58) Field of Search ..... 229/75, 69, 68.1, 229/74

(56) References Cited

U.S. PATENT DOCUMENTS

| | | | | | |
|---|---|---|---|---|---|
| 187,448 | A | * | 2/1877 | Breed | 229/68.1 X |
| 618,821 | A | * | 2/1899 | Barler | 229/68.1 X |
| 782,344 | A | * | 2/1905 | King | 229/75 |
| 929,515 | A | * | 7/1909 | Thomsom | 229/75 |
| 1,221,907 | A | * | 4/1917 | Rogalski | 229/75 X |
| 2,580,886 | A | * | 1/1952 | Broudy | 229/68.1 X |
| 2,719,734 | A | * | 10/1955 | Broudy | 229/75 |
| 3,243,205 | A | * | 3/1966 | Brogquist | 229/68.1 X |
| 3,369,732 | A | * | 2/1968 | Hanson | 229/75 |
| 3,570,752 | A | * | 3/1971 | Sczesniak | 229/75 |
| 4,190,162 | A | | 2/1980 | Buescher | |
| 4,454,980 | A | | 6/1984 | Poehler | |
| 4,775,095 | A | | 10/1988 | Emmott | |
| 4,915,287 | A | | 4/1990 | Volk et al. | |
| 5,141,252 | A | * | 8/1992 | Michlin | 229/68.1 X |
| 5,169,061 | A | | 12/1992 | Buescher | |
| 5,290,225 | A | | 3/1994 | Younger | |

* cited by examiner

*Primary Examiner*—Jes F. Pascua

(57) ABSTRACT

A single sheet stationery pattern and method for assembling an envelope/page includes a rectangular base sheet of face stock having a front, a back, a top, and a first (outside) and second (inside) sides, positioned so that the longest side of the rectangular base sheet is laid on a horizontal plane. The base sheet is adapted to receive a horizontal line of perforation (16), and two congruent holes (18A) and (18B), and an invaginated pre-creased seam at (16A). The base sheet is adapted to receive a first line of weakening (10) adjacent to the top of the pre-creased seam (16A) and parallel to the first side of the rectangular base sheet, placing a second line of weakening (12) adjacent to the bottom of the pre-creased seam (16A) and parallel to the first line of weakening and placing a third line of weakening (14) on a horizontal plane adjacent to bight or fold lines (10) and (12) and parallel to (16A). Applying a seam of pressure seal adhesive at (21) and (34) and applying re-wettable water soluble adhesive at seam strip (25). Folding in tab (20) overlaying tab (13) and securing with pressure seal adhesive strip (21). Folding in tab (17) and overlapping tab (13) to form the completed envelope/page. Separating envelope/page from binding strip along perforated line (16), wetting water soluble adhesive strip at (25) and sealing tab by folding down at invaginated seam 16(A) to form a completed mailer.

1 Claim, 4 Drawing Sheets

PATTERN AND METHOD OF ASSEMBLING AN ENVELOPE/PAGE AND MAILER COMBINATION

CROSS REFERENCE TO RELATED APPLICATIONS

This application is entitled to the benefit of the Provisional Patent Application Ser. No. 60/107,619, filed Nov. 9, 1998.

BACKGROUND—Field of Invention

This invention relates to stationery specifically to an envelope/page, designed with a perforated binding tab, which enables the envelope to become a removable page in a sign-in guest book or ledger. Once separated from the book and sealed the sign-in page becomes an envelope mailer.

BACKGROUND—Discussion of Prior Art

Thank-you cards and notes are currently purchased in sets, which include the card and an envelope. The most time-consuming aspect of sending out a thank-you card response is addressing the envelope with the correct address, city, state and zip code. When the event is a surprise, the recipient of the gift does not always know the current, full address of the gift giver. In the past, the recipient spent a lot of time looking up the complete address as well as addressing all of the return envelopes before mailing out the thank-you response. Because of the effort and time involved, it may sometimes take more than six months to receive a thank-you card response from a large social event such as a Wedding. The increasing popularity of computer generated address labels for use on personal as well as professional stationery points to the need for a more time-saving method. However, the disadvantage of the computer generated label is that the completed mailing information must still be compiled and fed into the computer and the hand written envelope is still the socially acceptable standard for formal correspondence. The sign-in envelope/page invention solves the problem and allows the recipient to send out a timely thank-you response. Although prior art teaches of multi-purpose envelope designs for commercial use as a two way mailer none have been found to introduce an envelope/page, specifically designed to be bound into a sign-in guest book or ledger, providing both a record of the guests in attendance at the event, as well as a detachable envelope addressed by the guest when they sign-in. The following U.S. patents have been found which may reflect on the envelope/page invention

| U.S. Pat. No. | Date | Inventor(s) |
|---|---|---|
| 4190162 | 2/26/80 | Buescher |
| 4454980 | 6/19/84 | Poehler |
| 4775095 | 10/4/88 | Emmott |
| 4915287 | 4/10/90 | Volk |
| 5169061 | 12/8/92 | Buescher |
| 5290225 | 3/1/94 | Younger |

Buescher's patent #4190162 relates to a 2 way snap open envelope designed with an end portion that separates to expose the contents The remaining portion provides a return reuseable envelope having an end closure flap, which when the return envelope is closed may cover a portion of the front panel, a portion of the back panel then becomes the front panel of the return envelope.

Poehler's patent # 4454980 teaches of a number of bill payer envelopes with computer imprinted confidential account information on the envelope flap. The envelopes are removably affixed to a continuous web, the web being subsequently folded to provide a flat booklet of envelopes.

Emmott's patent #4775095 discloses a side seam remailable envelope with perforated sides and top.

Volk's patent #4915287 relates to a set of communications documents each of which includes an integrated envelope and return coupon. The coupon can be removed from the envelope inserted into the remailable envelope and the flap sealed.

Buescher's patent #5169061 teaches of a two-way envelope with front and back removeable panels pre-printed with a reply address a bar code corresponding to the reply address and an identification code. When the reply envelope is closed only the reply address, bar code and identification code is displayed not the out-going address.

Younger's patent #5290225 relates to a two way envelope constructed from a single sheet business form construction printable in an impact or non impact printer. When folded, a mailer with an internal return envelope results.

Although each of the cited prior art references relate to innovative envelope adaptations and computer generated labels, none claim to have the same utility or design as the envelope/page invention described herein.

SUMMARY OF THE INVENTION

The envelope/page is an invention that relates to a new design for stationery that is comprised of an envelope with a detachable perforated binding strip that enables it to be both a sign-in page of a guest book or ledger as well as a detachable, sealable, mailable envelope

OBJECTS AND ADVANTAGES

Accordingly, several objects and advantages of my invention are that the envelope/page performs a dual function. The design of the envelope/page allows for it to be secured into the guest book as a sign-in page, so that it can serve as a record of the guests who attended the occasion. It also functions as an envelope, which when removed from the book along the perforated edge can be sealed and ready to mail out with either a thank-you response or a note card. It is the intent to provide for pre-printed prompts for name, address, city, state and zip code on the front surface of the envelope/page with transfer type press-on lettering which is commercially available and may be hand or machine applied. The prompts can be removed after the guest fills in the information by using an adhesive roller. The adhesive roller is similar to a lint remover and when rolled over the envelope will remove only the press-on lettering, leaving the guest name and address information intact. Although the press-on letter prompts are the most desirable way to ensure that the guest will completely fill out the envelope, it should be noted that the envelope/page with or without imprint lettering is the essence of the invention herein under consideration. Other objects and advantages are to provide a faster means to enable the recipient to send out a thank-you response or a notice of any kind following a special event or showing, provided the guests sign-in to the guest book upon arriving. Envelope/pages can be compiled in sets and offered in combination with an equal number of thank-you cards or notes and bound into a guest book which can be offered separately or as part of a set. Prior art has taught of numerous ways to enhance two-way correspondence between companies and their established clients. The envelope/page will help speed correspondence between the guest and the recipient of a gift or between a new client, whose mailing information was not known previously, attending and the group or individual sponsoring the event.

DESCRIPTION OF DRAWINGS

In the drawings

FIG. 1-B shows the envelope attached to a book or ledger by a reclosable fastener FIG. 1 is a one dimensional horizontal plane showing the front pattern for the envelope/page invention.

FIG. 1-A is the front view of the assembled envelope/page invention with the top binding tab still attached.

FIG. 2-A is the back view of the assembled envelope/page invention with the top binding tab still attached.

FIG. 1-B is the front view of the registry book showing the envelopes attached in a book by a reclosable fastener.

REFERENCE NUMERALS IN DRAWINGS

Figure 1:
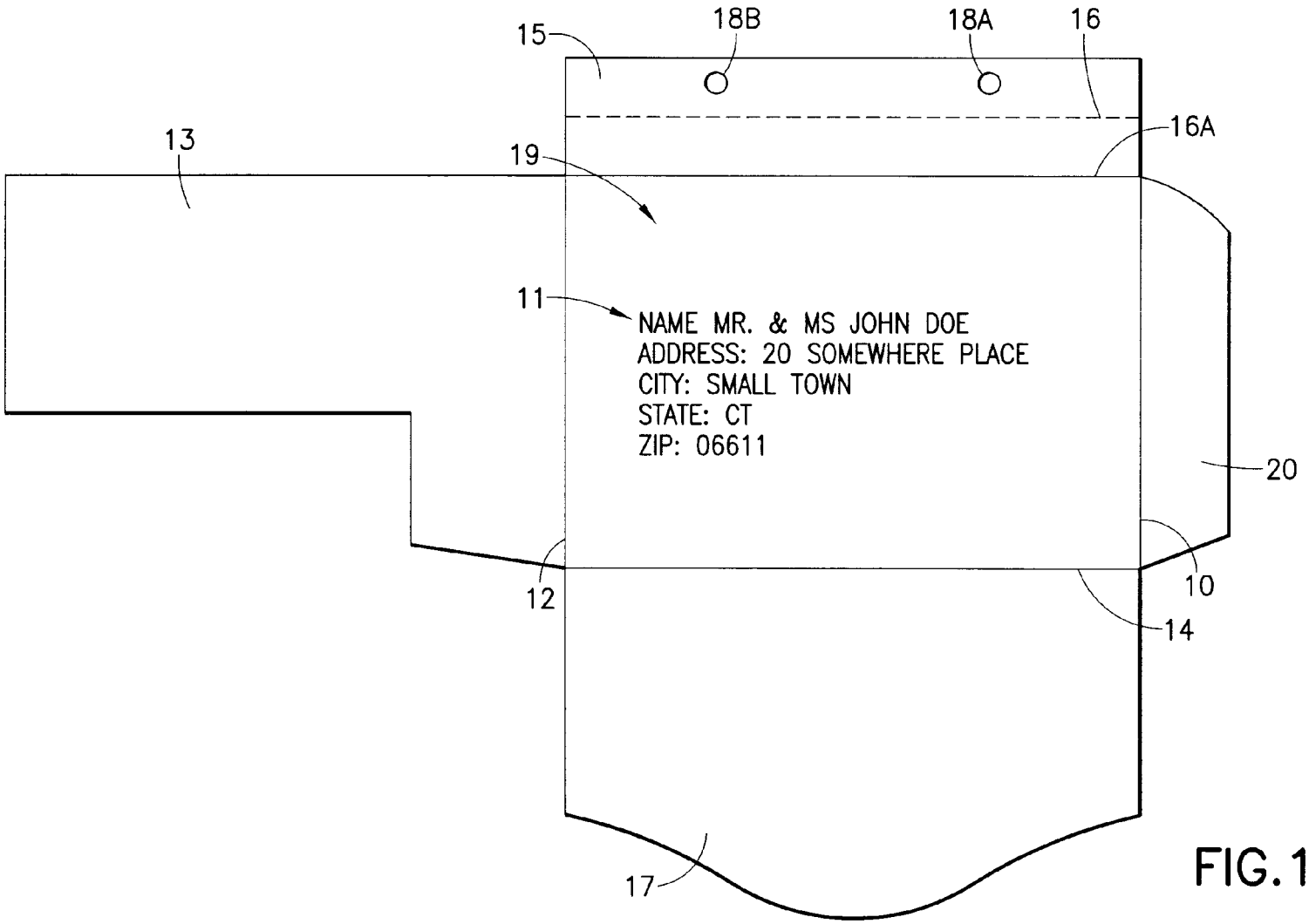
FIG. 1 is the front pattern of the envelope/page and FIG. 1-A shows the outside of the assembled envelope/page. The inside pattern of the envelope/page is shown in FIG. 2 and FIG. 2-A shows the back view of the assembled envelope/page respectively.
Figure 1A:
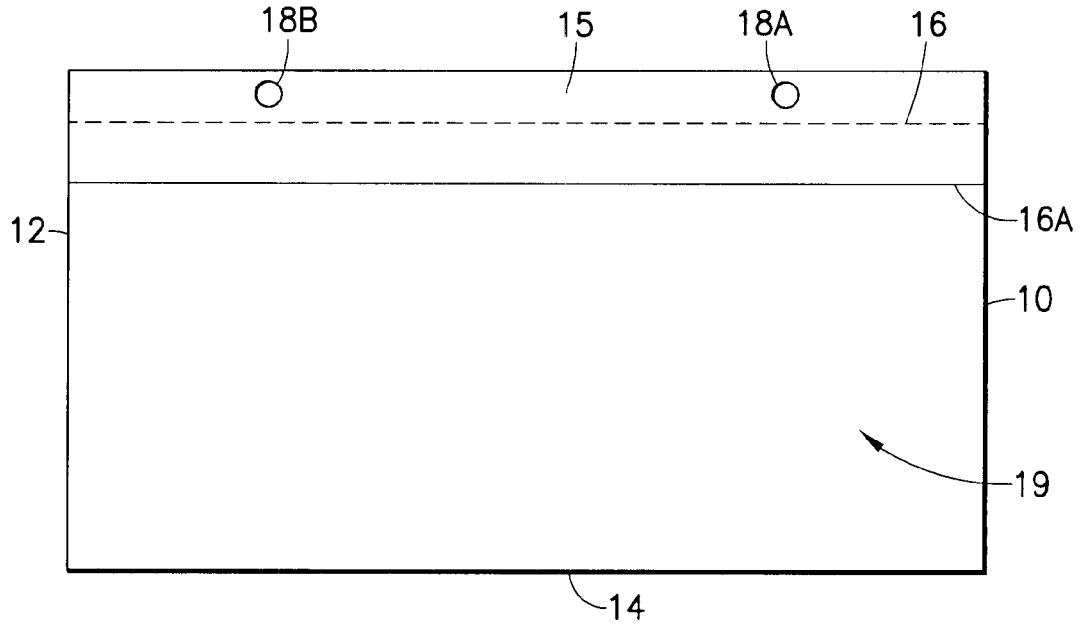
Figure 1B:
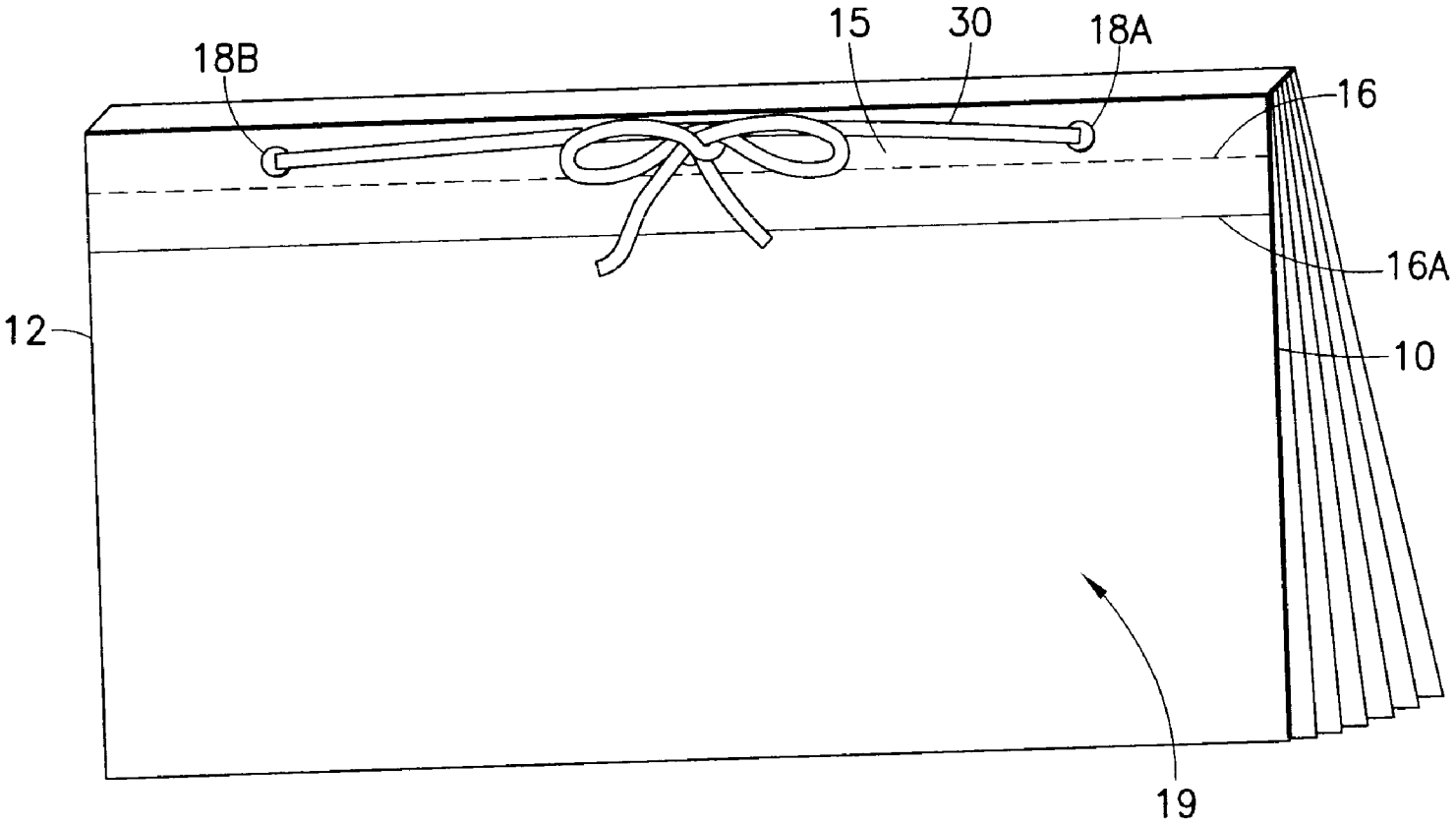

The numerals referring to all frontal views are:

10 Bight or fold line
11 Optional transfer type lettering for name and address
12 Bight or fold line
13 Side flange or tab
14 Bight or fold line
15 Margin
16 Serrated line
16A Invaginated pre-creased seam
17 Bottom flange or tab
18A Top congruent boring hole
18B Bottom congruent boring hole
19 Front addressable plane
20 Top flange or tab The numerals referring to all inside and back views are:

10 Bight or fold line
12 Bight or fold line
13 Side flange or tab
14 Bight or fold line
15 Margin
16 Serrated line
16A Invaginated pre-creased seam
17 Bottom sealing tab
18A Top congruent boring hole
18B Bottom congruent boring hole
20 Top flange or tab
21 Side adhesive strip
25 Water soluble adhesive seam strip
29 Underside of addressable plane
30 Cord or other means for binding.
34 Adhesive seam strip

DESCRIPTION OF INVENTION

Figure 2A:
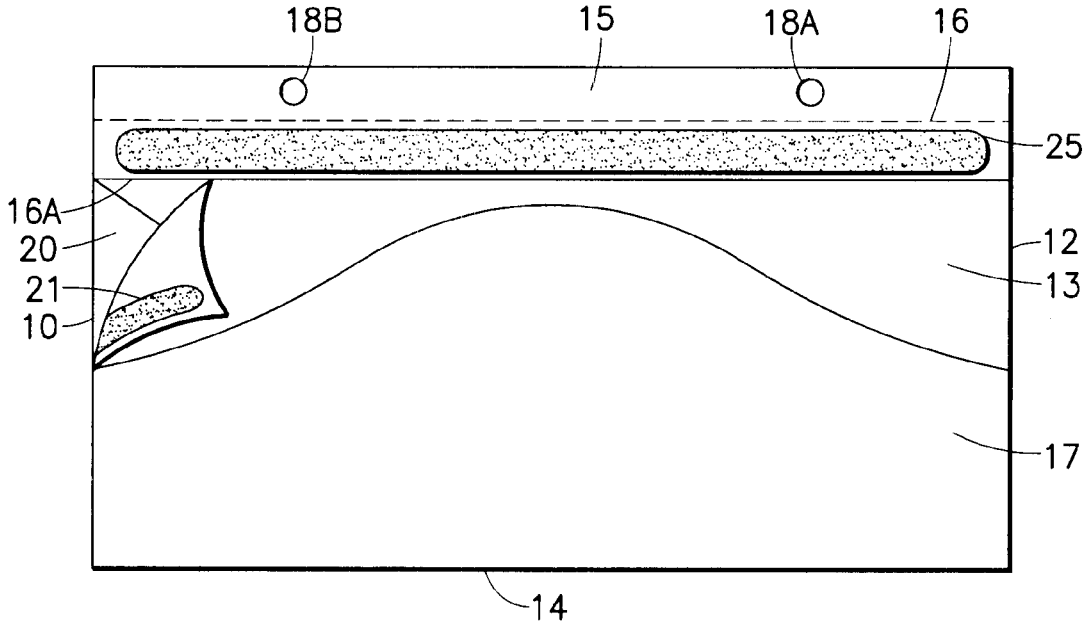
FIG. 2 is a one dimensional plane showing the underside or back of the envelope/page and the adhesive specifications for the envelope/page invention.
Figure 2:
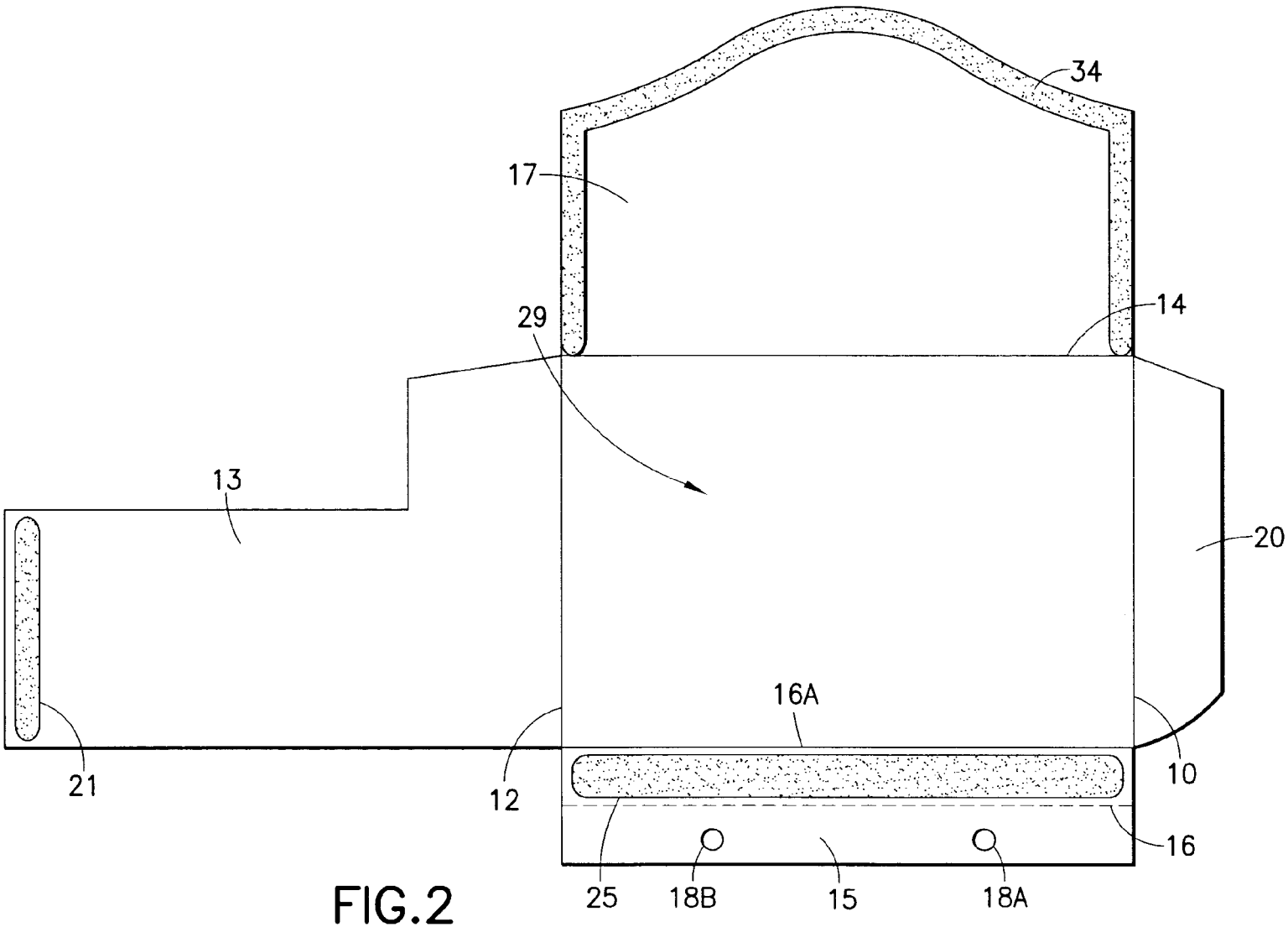

A method of making an envelope/page from a single sheet. A preferred embodiment of the present invention is illustrated in FIG. 1 and FIG. 2 showing the front and back views of the pattern for the envelope/page and FIG. 1-A and FIG. 2-A showing the assembled front and back views of the finished envelope/page invention with binding tab still attached. A method of making an envelope/page from a single sheet comprising the steps of;

a) A rectangular base sheet of face stock having a front, a back, a top, a bottom, and first (outside) and second (inside) sides, positioned so that the longest side of the rectangular base sheet is laid on a horizontal plane and cut to conform to the pattern illustrated in FIG. 1.

b) Positioning the sheet so that the longest side is laid on a horizontal plane, placing a horizontal line of perforation approximately ¾ inch in from the left side as shown in FIG. 1 at perforated line 16.

c) Placing two congruent boring holes in the ¾" margin along the horizontal plane at 18A and 18B as shown in FIG. 1.

d) Placing an invaginated pre-creased seam 16A along a horizontal plane parallel to 16.

e) Placing a first line of weakening adjacent and parallel to the first side or fold tab on the front of the rectangular base sheet as shown in FIG. 1.

f) Placing a second line of weakening, bight 12 parallel to the first line of weakening, bight 10 as shown in FIG. 1.

g) Placing a third line of weakening bight 14 adjacent to bight 10 and bight 12 parallel to 16A.

h) Applying pressure seal adhesive strip as shown in FIG. 2, inside view of envelope/page, at 21 and 34 and applying re-wettable water soluble adhesive at seam strip 25.

i) Folding in tab 20 along fold or bight line 10 as shown in FIG. 1 and folding in tab 13 at fold line 12 to overlap tab 20 as shown in FIG. 2-A and securing with tab 17 at adhesive strip 34 as shown in FIGS. 2 and 2-A.

j) Folding in tab 17 as shown in FIG. 1 along bight 14, overlapping tab 13 as shown in FIG. 1, to form the complete envelope/page as shown in FIG. 1-A, front view of assembled envelope/page and FIG. 2-A, back view of assembled envelope/page.

k) Separating envelope/page from binding strip along perforated line 16, wetting water soluble adhesive strip at 25 and sealing tab by folding down at invaginated seam 16A to form a completed mailer.

OPERATION OF INVENTION

The manner of using the envelope/page as a page in a guest book or ledger requires that a pre-determined number of individual envelope/pages be bound in a book, being approximate in size to accommodate the completed envelope/page, comprised of a front and back cover with two congruent boring holes to align with boring holes 18A and 18B on the front view of the assembled envelope/page as shown in FIG. 1-A and a pre-creased seam on the front cover of the guest book at a point aligned with pre-creased seam 16A shown in FIG. 1-A. The guest book is assembled by using one end of a pre-determined length of cord or tie or other means for binding such as a re-closable ring inserted into the hole lining up with 18A on the envelope/page, from underneath the back cover to loop from the back of the guest book cover through each individual envelope/page until each one of a pre-determined number of envelope/pages is threaded. The other end of the cord or tie being inserted into a second hole in the back cover of the guest book lining up with hole 18B on the envelope/page and then through each individual envelope/page at hole 18B until each one of a pre-determined number of said elements is threaded. Then each end of the cord, one end having been threaded through hole 18A and the second end having been threaded through hole 18B, are threaded through the front cover of the guest book having pre-set boring holes in the same location as the back cover and the envelope/page, at points 18A and 18B as shown in FIG. 1-A. The remaining cord being secured in a knot or bow to bind the pages into the book. In this manner, the guest book or ledger can be expanded to accommodate as many sign-in envelope/pages as are needed.

The front and back cover, although desirable in enhancing the look of the guest book and organizing the envelope/pages, is optional and is only mentioned here to clarify how the invention would be presented when offered to the consumer. Every guest signs in, filling in their name and complete mailing address, one page per guest. After the event is concluded, the pre-addressed envelope/page is removed from the book, by tearing along the perforated strip at 16 on FIG. 1-A,filled with the appropriate correspondence stationery and sealed. The completed mailer is now ready for postage and handling The envelope/page invention saves the sender time, allows for a speedy response and ensures that the correspondence will reach the proper individual at their current address. The prior art references relevant to my invention do not relate to situations in which the intended recipient's address is not known, as in the case of a new client or friend and disclose only two-way mailers. An additional advantage of my invention over the prior art is that prior art teaches an envelope design geared for commercial use, the envelope/page invention can be used by the consumer in a social function such as a Christening or Bar Mitzvah as well as by a company in a business environment, such as a Grand Opening event.

CONCLUSION, RAMIFICATIONS, AND SCOPE

Accordingly, the reader will see that the envelope/page invention, serves the dual purpose of guest book registration page, as well as an envelope mailer for sending out a thank-you response or other notice. Additional advantages are that:

(a) The guests sign the guest book with their name and complete address so the respondent can be assured that the correspondence will be sent to the correct address.

(b) The envelope/page has been pre-addressed by the guest so that an economy of time is realized.

(c) The person or organization hosting the event can use the expandable binding feature to ensure that the correct number of sign-in pages can be added to correspond to the correct number of intended guests. Although the description above contains many specificities, these should not be construed as limiting the scope of the invention but as merely providing illustrations of some of the preferred embodiments of this invention. For example, the size of the envelope/page can be increased or decreased to fit the type of correspondence to be mailed and the two congruent holes used for binding the envelope/pages to the guest book can be replaced by other means for binding such as, a re-closable ring fastener eliminating the need for a cord or ribbon closure.

Thus the scope of the invention should be determined by the appended claims and their legal equivalents, rather than by the examples given.

I claim:

1. An envelope made from a single sheet of face stock comprising:

a rectangular plane having a front surface and back surface with the front surface carrying a pre-printed, removable press-on prompts for a name and complete address to be printed on the front surface:

the rectangular plane includes first and second opposing edges with each edge having a side tab foldably extending therefrom, one of the tabs carrying an adhesive for securing to the other tab in an overlapping configuration to form the sides of the envelope;

the rectangular plane further includes third and fourth opposing edges; the third edge having a bottom tab foldably extending therefrom that carries an adhesive for securing the bottom tab to the overlapping side tabs and for forming the bottom of the envelope, the fourth edge having a sealing tab foldably extending therefrom and carrying an adhesive strip for closing the envelope; and a margin extending from the sealing tab, the margin being separable from sealing tab by a line perforations, the margin further including a plurality of holes for removably attaching the envelope to a book.

* * * * *